US006072275A

United States Patent [19]

Kobashi

[11] Patent Number: 6,072,275

[45] Date of Patent: Jun. 6, 2000

[54] LIGHT EMITTING ELEMENT AND FLAT PANEL DISPLAY INCLUDING DIAMOND FILM

[75] Inventor: Koji Kobashi, Kobe, Japan

[73] Assignee: Kabushiki Kaisha Kobe Seiko Sho, Kobe, Japan

[21] Appl. No.: 09/076,803

[22] Filed: May 13, 1998

[51] Int. Cl.[7] ..... H01J 63/04

[52] U.S. Cl. ..... 313/506; 313/502; 313/509; 313/512; 313/309; 313/336

[58] Field of Search ..... 313/502, 506, 313/509, 512, 309, 310, 336, 351, 498

[56] References Cited

U.S. PATENT DOCUMENTS 4,695,859 9/1987 Guha et al. ..... 357/19
5,243,199 9/1993 Shiomi et al. ..... 257/77
5,506,422 4/1996 Dreifus et al. ..... 257/77
5,612,548 3/1997 Saito et al. ..... 257/77

*Primary Examiner*—Vip Patel
*Attorney, Agent, or Firm*—Oblon, Spivak, McClelland, Maier & Neustadt, P.C.

[57] ABSTRACT

A light emitting element and a flat panel display that includes the element has a diamond film, which can achieve a stable and strong light emission with low electricity consumption. The light emitting element has a multilayer structure with an optional base material, a lower electrode, a diamond film, a fluorescent thin film, an upper electrode, and an upper electrode for wiring purposes. Under a proper biasing voltage between the lower and upper electrodes, carriers (either electrons or holes) are injected from the lower electrode to the diamond film, and are accelerated in the diamond film, so as to excite the fluorescent thin film and cause the thin film to fluoresce.

26 Claims, 7 Drawing Sheets

LIGHT EMITTING ELEMENT AND FLAT PANEL DISPLAY INCLUDING DIAMOND FILM

BACKGROUND OF THE INVENTION

1. Field of the invention

The present invention is related to a light emitting element and a flat panel display having a diamond film that can achieve a high brightness with low electricity consumption.

2. Description of the Related Art

Diamond is known to have excellent resistance to high temperature, have a large band gap (5.5 eV), and hence is electrically a good insulator when undoped. However, diamond can be semiconducting by doping suitable impurity atoms in the diamond. Furthermore, diamond has excellent electrical properties such that the breakdown voltage is high, the saturation velocities of carriers (electrons and holes) are also high, and the dielectric constant, and hence the dielectric loss, is small. It is also well known that diamond has the highest thermal conductivity among all materials at room temperature, and the specific heat is small.

Regarding chemical vapor deposition (CVD) of diamond film, the following techniques are known: microwave plasma CVD (for example, see Japanese patents (Laid Open) Nos. Sho 59-27754 and Sho 61-3320), radio-frequency plasma CVD, hot filament CVD, direct-current plasma CVD, plasma-jet CVD, combustion CVD, and thermal CVD. By these techniques, it is possible to form continuous diamond films over a large area at low cost on substrates of non diamond materials.

Recently, a vacuum field emission-type light emitting clement was proposed that consists of an electrode coated with a fluorescent material that faces a diamond film in vacuum. In the light emitting element, electrons are emitted from the diamond film, travel through vacuum, are accelerated toward the electrode under a high voltage between the diamond film and the electrode, and the light emission takes place in the fluorescent material due to the electronic excitation by the injected high energy electrons. Also, light emitting elements using silicon or metals, instead of diamond film, have been proposed (see J. Ito, "Vacuum microelectronics", Oyo Butsuri, Vol. 59, No. 2 (1990), and K. Yokoo, "Vacuum microelectronics, the world of new vacuum devices", Journal of IEEE Japan, Vol. 112, No. 4 (1992)).

FIG. 12 shows an example of a cross-sectional view of a light emitting element using silicon, referred to as "Background Art 1". In FIG. 12, a conducting silicon layer 1 is formed on an insulating substrate 12, and then a cone-shape electron emitter 2 is formed on the surface of the silicon layer by microfabrication. A fluorescent electrode 6 is placed to oppose the emitter 2 across from the vacuum 7. The fluorescent electrode 6 is formed by successively depositing a transparent electrode 4 and a fluorescent thin film 5 on a transparent plate 3. The transparent electrode 4 and the silicon substrate 1 are connected to a power supply 9 to apply a voltage between them.

In the light emitting element according to Background Art 1 (FIG. 12), electrons 8 are emitted from the silicon electron emitter 2 toward the fluorescent electrode 6 by applying an electrical voltage between the fluorescent electrode 6 and the silicon substrate 1. The electrons 8 then electronically excite the fluorescent thin film 5 to make it fluoresce.

FIG. 13 shows a cross-sectional view of a light emitting element with a gate electrode for a flat panel display using silicon. This will be hereafter referred to as "Background Art 2". The difference between the light emitting element shown in FIG. 13 and that shown in Background Art 1 lies in the use of an insulating layer 11 formed around the emitter 2 on the silicon substrate 1, and a gate electrode 10 surrounding the emitter 2 formed on the insulating film 11. The flow of electrons 8, and hence the brightness of the fluorescence light from the fluorescent thin film 5, can be controlled by changing the voltage at the gate electrode 10.

In Background Arts 1 and 2, the fluorescence colors can be arbitrarily controlled by selecting a suitable material for the fluorescent thin film 5. It is also possible to fabricate a flat panel display from a two-dimensional array of the light emitting elements.

However, as presently appreciated, there is a problem in Background Arts 1 and 2 in that electron emission characteristics deteriorate shortly after the operation. This is attributed to the silicon, used for the electron emitter 2, not being sufficiently resistant to heat. As a result, the tip of the electron emitter 2 is easily rounded by the heat generated during the operation, which consequently reduces the gradient of the electric field near the tip, and hence the electron emission. The electron emission characteristics also deteriorate because of silicon oxidation by residual oxygen in the vacuum gap 7 of FIGS. 12 and 13. Oxygen is known to easily react with silicon to form an insulating $SiO_2$ layer on the surface of the electron emitter 2 and increase its work function. For those reasons, a silicon emitter has never been employed for practical use because the emitter lifetime is not sufficiently long, and the silicon emitter can not sustain high electric power.

There is another problem of non-uniform brightness across the display in the vacuum field emission-type display because it is very difficult to maintain a constant vacuum gap 7 between electron emitters and electrodes within a micron-order precision over the entire area of the display.

The problems stated above are more or less similar for metal emitters, and can not be completely solved by using any materials for the electron emitter. The essential cause of the above problems lies in the fact that the vacuum gap 7 exists between the emitter 2 and the fluorescent electrode 6 in Background Arts 1 and 2.

It is well known that diamond exhibits a good electron emission under a negative voltage (see, C. Wang et al, Electronics Letters, Vol. 27, No. 16, p. 1459, (1991)), and thus diamond particles and films grown by CVD are currently investigated as a promising material for high performance electron emitter applications. However, the electric current from diamond is only on the order of 10 $mA/cm^2$, significantly smaller than the typical value, 1000 $mA/cm^2$, for an integrated silicon electron emitter array.

It was also reported that electrons in diamond can drift without energy loss due to electron-phonon interaction in a high electric field greater than $10^4$ V/cm (see, Z.-H. Huang et al, Applied Physics Letters, Vol. 67, No. 9. p. 1235 (1995)).

The present invention is proposed to solve above stated and problems. It is an object of the present invention to provide a light emitting element and a flat panel display having a diamond film that achieve a stable and high light emission with low electricity consumption because no vacuum gap is required between the lower electrode and the fluorescent film in the present device structure.

SUMMARY OF THE INVENTION

The light emitting element having the diamond film of the present invention is characterized by the structure that includes a lower electrode that injects carriers (electrons or holes), a diamond film that is formed on said lower electrode and transports the carriers, a fluorescent film that is formed on the surface of said diamond film and fluoresces by electronic excitation due to the injection of the carriers, and an upper electrode that is formed on the fluorescent film.

In the light emitting element of the present invention, the diamond film plays a role of "vacuum." As noted above, electrons in diamond can drift at high speed without energy loss due to electron-phonon interaction, if the electric field in the diamond film is greater than $10^4$ V/cm. Namely, under such a high electric field, carriers in diamond film can be transported at a speed as high as they would in vacuum, and hence the high energy carriers are injected into the fluorescent film. Therefore, in the present invention, such problems as those associated with the device structure of Background Arts 1 and 2 does not exist, because the vacuum is not included. It is noted here that, in the present invention, it is possible to use holes as the injecting carriers, because the holes can travel in the diamond film.

In the present invention, it is preferable that the lower electrode is composed of Pt or Pt alloys which include Pt greater than 50 atomic %, because the quality of the diamond films grown on the materials was found to be very high, according to the experiments done by the present inventors. It is also preferable that the surface of the lower electrode is rough, because the carrier injection efficiency from the rough surface is improved.

The diamond film can be undoped or boron-doped with the boron concentration of less than $1\times10^{18}/cm^3$. It is possible that the boron concentration profile is continuously modulated along the direction of the thickness of said diamond film. In the case that the injected carriers are holes, the carrier injection efficiency is greatly improved, if the diamond region within 1 mm from the lower electrode surface is heavily boron doped with the boron concentration of greater than $1\times10^{18}/cm^3$.

The upper electrode can be a transparent conducting film such as ITO (Indium-Tin-Oxide). It is also possible to use an insulating base material under the lower electrode.

The second structure of the light emitting element in the present invention includes a lower electrode that injects carriers, a diamond film that is formed on the lower electrode and transports the carriers, a gate electrode formed on the diamond film surface and controls the flow rate of said carriers, a fluorescent film formed on the surface of the diamond film surface and fluoresces by excitation due to carrier injection, and an upper electrode formed on the surface of the fluorescent film. It is preferable in the flat panel display that an insulating intermediate layer is formed between the gate electrode and the diamond film, because the leakage current from the gate electrode can be suppressed.

This structure is most suitable for light emitting elements in flat panel displays because the flow rate of the carriers injected from the lower electrode, and hence the brightness of the flat panel display, can be controlled by applying an electric voltage to the gate electrode.

In the present invention, it is possible to use either electrons or holes as the injecting carriers, because vacuum is not included in the device structure.

BRIEF DESCRIPTION OF THE DRAWINGS

A more complete appreciation of the present invention and many of the attendant advantages thereof will be readily obtained as the same becomes understood by reference to the following detailed description when considered in connection with the accompanying drawings, wherein.

In the above figures, and throughout the following text description the labeled numbers have the following meanings although these specific labels should not be construed narrowly and should cover all technical equivalents as well:

1, silicon substrate;
2, silicon emitter;
3 and 37, transparent plate;
4, transparent electrode;
5 and 25, fluorescent thin film;
6, fluorescent electrode;
7, vacuum gap;
8, electrons;
9 and 29, power supply;
10 and 35, gate electrode;
11 and 36, insulating layer;
12, insulating substrate;
21 and 21*a*, lower electrode;
23, electrode for wiring;
24, upper transparent electrode;
27, diamond film;
28, carriers;
32 and 32*a*, base material;
34, heavily boron-doped diamond layer;
39, intermediate insulating layer; and
40, light emitting element.

DESCRIPTION OF THE INVENTION AND PREFERRED EMBODIMENTS

Figure 1:
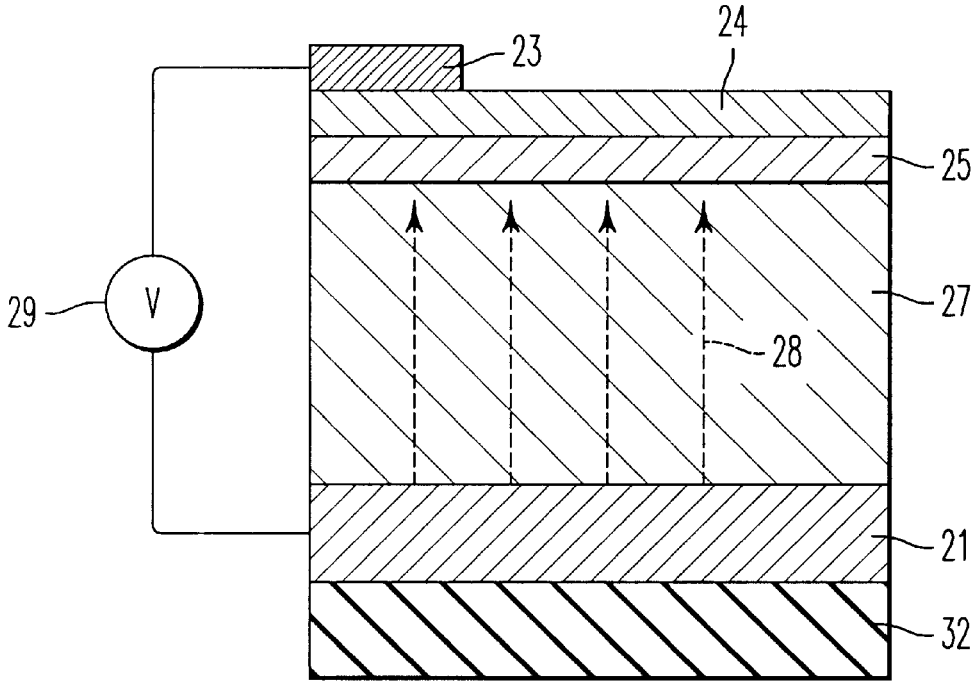
FIGS. 1 through 8 are cross-sectional views of light emitting elements according to the first through eighth embodiments of the present invention, respectively.

Referring now to the drawings, and more particularly to FIG. 1 thereof, FIG. 1 is a cross-sectional view of the light emitting element according to the first embodiment of the present invention. As shown, a lower electrode 21 is formed on a base material 32 and a diamond film 27 is grown on the lower electrode 21 by CVD. A fluorescent thin film 25 and an upper transparent electrode 24 are successively deposited on the diamond film 27, and an electrode 23, for wiring, is formed on the upper transparent electrode 24. The wiring electrode 23 and the lower electrode 21 are connected to the power supply 29 as shown. The power supply 29 is controllable such that a varying voltage may be applied between the electrodes 23 and 21.

In FIG. 1, when a negative voltage is applied to the lower electrode 21, electrons serving as carriers 28 are injected from the lower electrode 21 to the diamond film 27. The electrons are accelerated in the diamond film 27, and injected into the fluorescent thin film 25 to make the fluorescent thin film 25 fluoresce. On the other hand, when a positive voltage is applied to the lower electrode 21, holes as carriers 28 are injected from the lower electrode 21 to the diamond film 27.

In FIG. 1, the diamond film 27 is positioned between (as shown in a "sandwiched" configuration) the lower electrode 21 and the fluorescent thin film 25. As stated before, the carriers 28 in the diamond film can drift at high speed without significant energy loss due to electron-phonon interaction, if the electric field in the diamond film 27 is greater than $10^4$ V/cm. Moreover, under such a high electric field, the carriers 28 can drift in the diamond film 27 as if they are in vacuum. In Background Arts 1 and 2, problems of limited lifetime and power handling are present, but no such problems are encountered in the present invention because vacuum is not involved in the present device structure.

In FIG. 1, it is possible to use any conducting material for the lower electrode 21 such as metals, ceramics, and diamond as well as multilayer materials that use the conducting material(s). It is only necessary that the material be resistant to high temperature, e.g. between 400 and 1000° C., because the diamond film 27 is grown on the lower electrode 21 by CVD.

It has been confirmed by the present inventors that a high quality (low defect density) diamond film can be grown, if Pt or Pt alloys with Pt greater than 50 atomic % is used as the substrate for diamond CVD. Therefore, it is most preferable to use the Pt or Pt alloys as the lower electrode 21. An additional advantage in this case is that the light emitted from the fluorescent thin film 25 is reflected by the lower electrode 21, and hence increases the light emission intensity.

Figure 2:
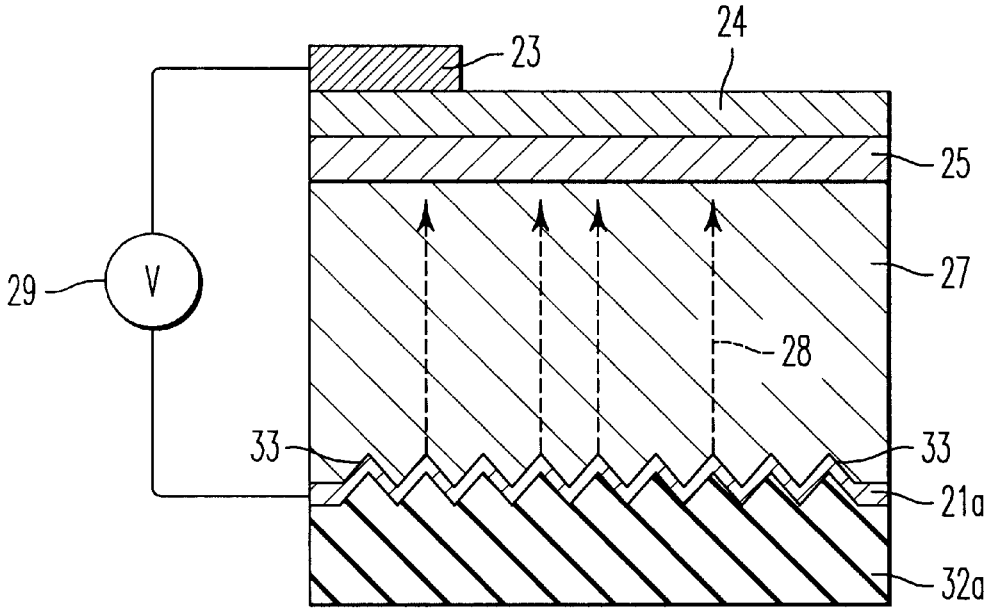

FIG. 2 shows a cross-sectional view of the light emitting element according to the second embodiment of the present invention. The only difference between FIG. 2 and FIG. 1 is that the surface of the base material 32*a,* and hence that of the lower electrode 21*a,* is rough, relative to planar structures. The surface is rough in the sense that the surface has an undulating topology with relative minima and maxima. The rough surface includes tips 33 as shown. Because of this roughness, better carrier injection efficiency is achieved in the second embodiment over the first embodiment (FIG. 1), as the carrier injection from the tips 33 is facilitated.

It is desirable that the defect density of the diamond film 27 is small because the carriers 28 injected from the lower electrode 21 or 21*a* must be efficiently accelerated in the diamond film 27. Therefore, it is preferable that the diamond film 27 is undoped or boron-doped with a boron concentration being less than $1\times10^8/cm^3$. The boron concentration profile in the diamond film 27 can be modulated along the direction of the thickness of the diamond film 27.

Figure 3:
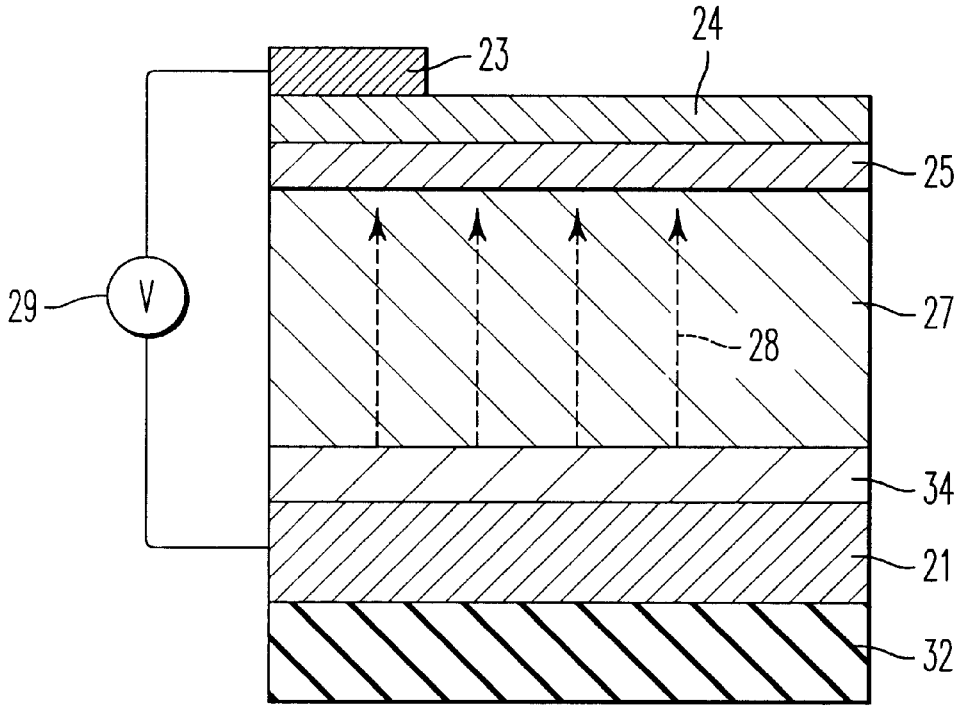

FIG. 3 is a cross-sectional view of the light emitting element according to the third embodiment of the present invention. The only difference between FIG. 3 and FIG. 1 is that a heavily boron-doped layer 34 with the boron concentration greater than $1\times10^{18}/cm^3$ is formed in the diamond film 27 within a 1 mm region from the surface of the lower electrode 21. It should be noted that when a positive voltage is applied at the lower electrode 21, the hole injection efficiency from the lower electrode 21 is better in the third embodiment than in the first embodiment, and thus a stronger light emission occurs at a lower voltage.

Figure 4:
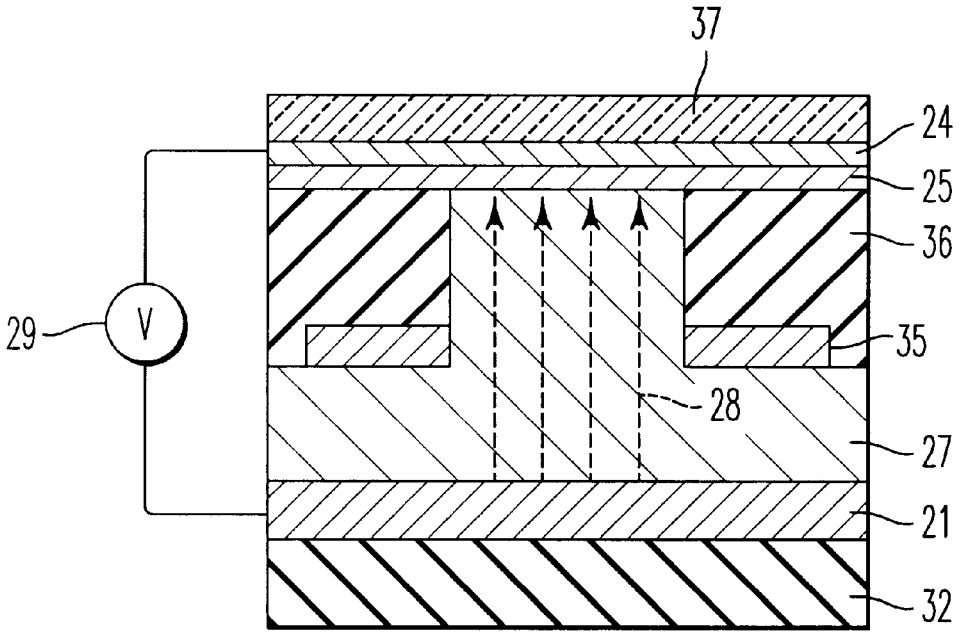

FIG. 4 is a cross-sectional view of the structure of the light emitting element according to the fourth embodiment of the present invention, which is preferable for a light emitting element of a flat panel display. FIG. 4 differs from FIG. 1 in that the gate electrode 35 and the insulating layer 36 are included on the surface of the diamond film 27 as shown.

FIG. 4, carriers 28 are injected from the lower electrode 21 to the diamond film 27 in the same manner as in the first embodiment. The carriers 28 are then accelerated in the diamond film 27, and excite the fluorescent thin film 25 so as to fluoresce the fluorescent thin film 25. However, since the gate electrode 35 is present on the surface of the diamond film 27, it is possible to control the flow rate of carriers injected from the lower electrode 21, and hence the brightness of the light emitting element may be changed by changing the voltage at the gate electrode 35. A separate controllable voltage source may be provided for this purpose.

Figure 5:
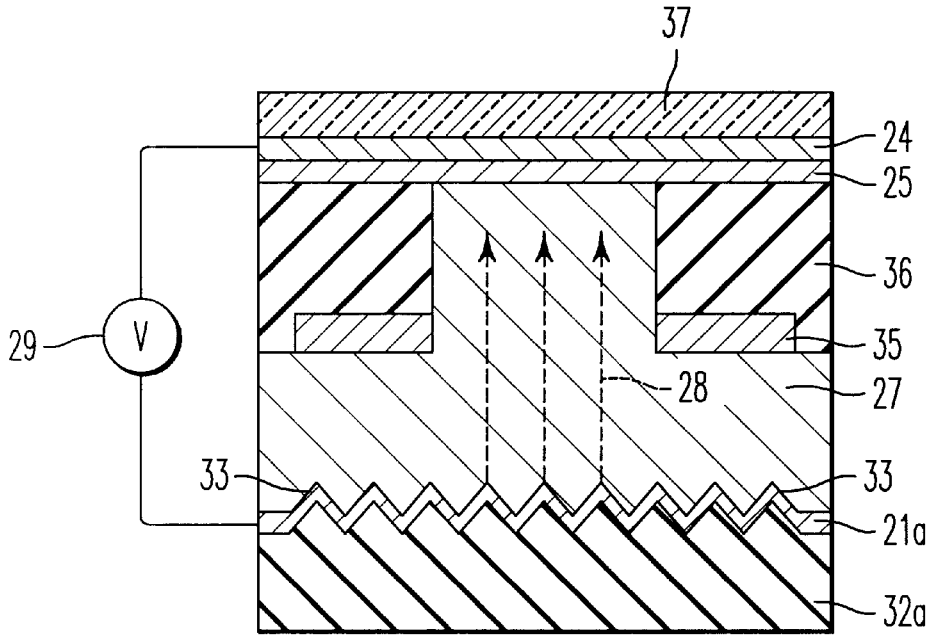

FIG. 5 is a cross-sectional view of the light emitting element according to the fifth embodiment of the present invention. FIG. 5 differs from FIG. 2 in that the gate electrode 35 is present on the surface of the diamond film 27 as is the insulating layer 36.

In FIG. 5, the basic mechanism of light emission is similar to that of the first and fourth embodiments. However, it should be noted that unlike the fourth embodiment, the surface of the lower electrode 21*a* is rough. Therefore, the same advantage as described for the second embodiment is present. Furthermore, a better carrier injection efficiency over the fourth embodiment can be obtained because the surface of the lower electrode 21*a* is rough and hence carrier injection from the tip 33 is facilitated and the light emission is obtained at lower voltage.

Figure 6:
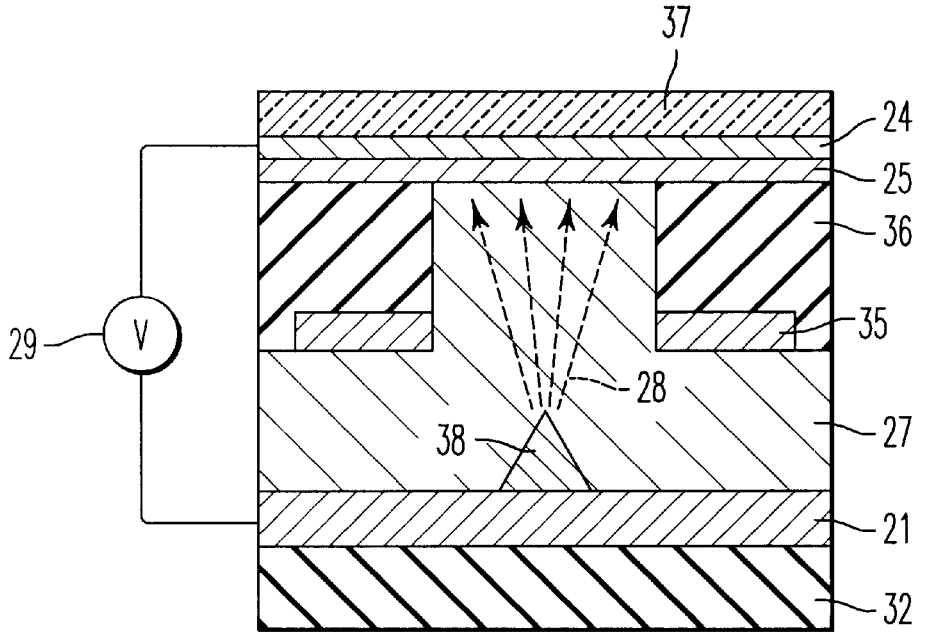

FIG. 6 is a cross-sectional view of a light emitting element according to the sixth embodiment of the present invention. FIG. 6 differs from FIG. 4 in that a single tip 38 is formed on the lower electrode 21. In this case, the position of light emission in the fluorescent thin film 25 can be precisely controlled, if the single tip 38 is formed at a well-defined position on the surface of the lower electrode 21. It should be noted that a multiple tip structure is possible, as well.

Figure 7:
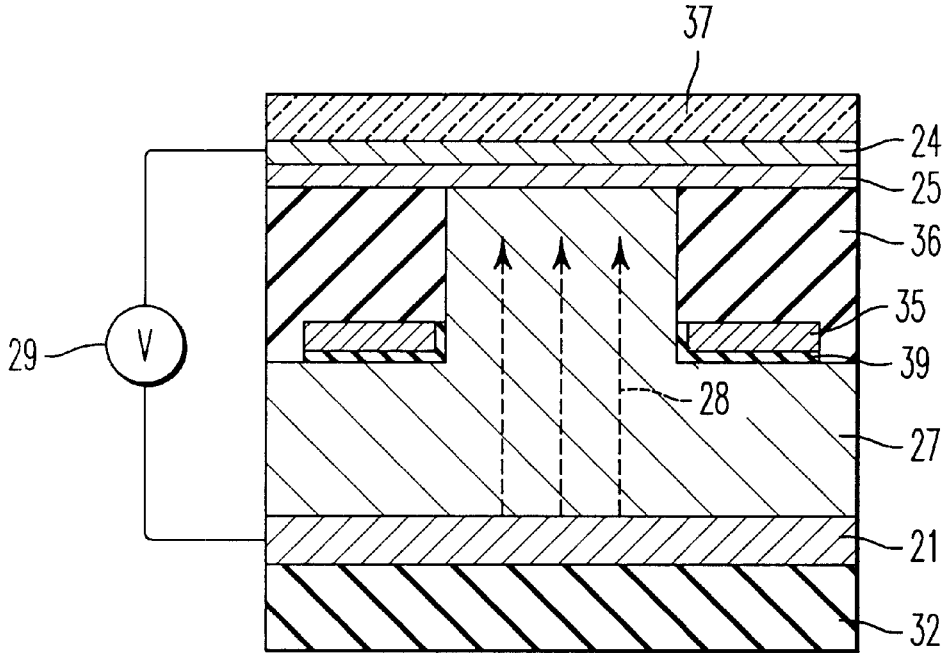

FIG. 7 is a cross-sectional view of the light emitting element according to the seventh embodiment of the present invention. FIG. 7 differs from FIG. 4 in that the intermediate layer 39, which is composed of an insulating material, is present between the gate electrode 35 and the diamond film 27.

In FIGS. 4 to 6, the gate electrode 35 is directly deposited on the surface of diamond film 27. On the other hand, when the insulating intermediate layer 39 is formed between the gate electrode 35 and the diamond film 27 as shown in the present example, the leakage current from the gate electrode 35 can be markedly suppressed. As for a material for this intermediate layer 39, $SiO_2$, $Si_3N_4$, and other electric insulators can be utilized.

In the light emitting elements shown in FIGS. 4 to 7, since the defect density of the diamond film 27 must be small, it is preferable that the diamond film 27 is undoped or boron-doped with the boron concentration of less than $1\times10^{18}/cm^3$. The results are similar, even if the boron concentration profile is continuously modulated along the direction of the thickness of the diamond film 27.

Figure 8:
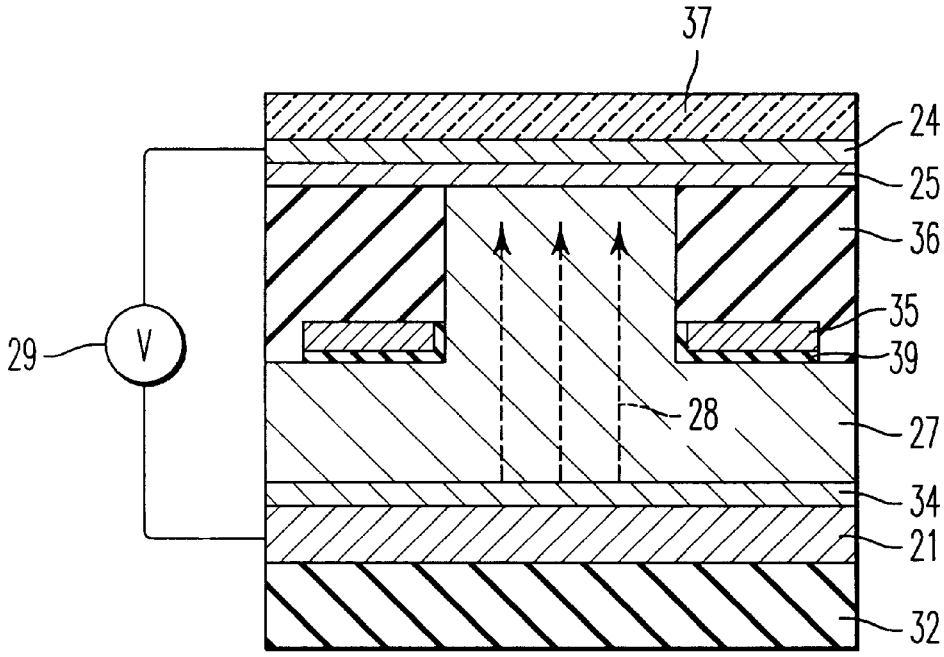

FIG. 8 shows a cross-sectional view of the light emitting element according to the eighth embodiment of the present invention. FIG. 8 differs from FIG. 7 in that a heavily boron-doped layer 34, in which the boron concentration is greater than $1\times10^{18}/cm^3$, exists in the diamond film 27 within the 1 $\mu$m region from the surface of the lower electrode 21 in a similar manner to the third embodiment.

It should be noted here that the first through eighth embodiments of the present invention are mere examples of many possible structures, and more complex structures in combination with these embodiments, as well as combinations of the present embodiments themselves, are not excluded from the viewpoint of the present invention.

In the light emitting elements of FIGS. 1 to 8, the upper electrode 24 can be a transparent conducting film in order to transmit the emitted light from the fluorescent thin film 25. For such materials, ITO, $SnO_2$, $ZnO_2$, $SnO_2$—Sb, and $Cd_2SnO_4$ may be used.

The base material 32 or 32*a*, on which the lower electrode 21 or 21*a* is formed, can be an insulating material. It is also possible to omit the base material. Moreover, it is not necessary that the light emitting element be a point source of light. The shape of the light emitting element may be one of many including linear, curved, planar, and a curved surface shape.

Figure 9:
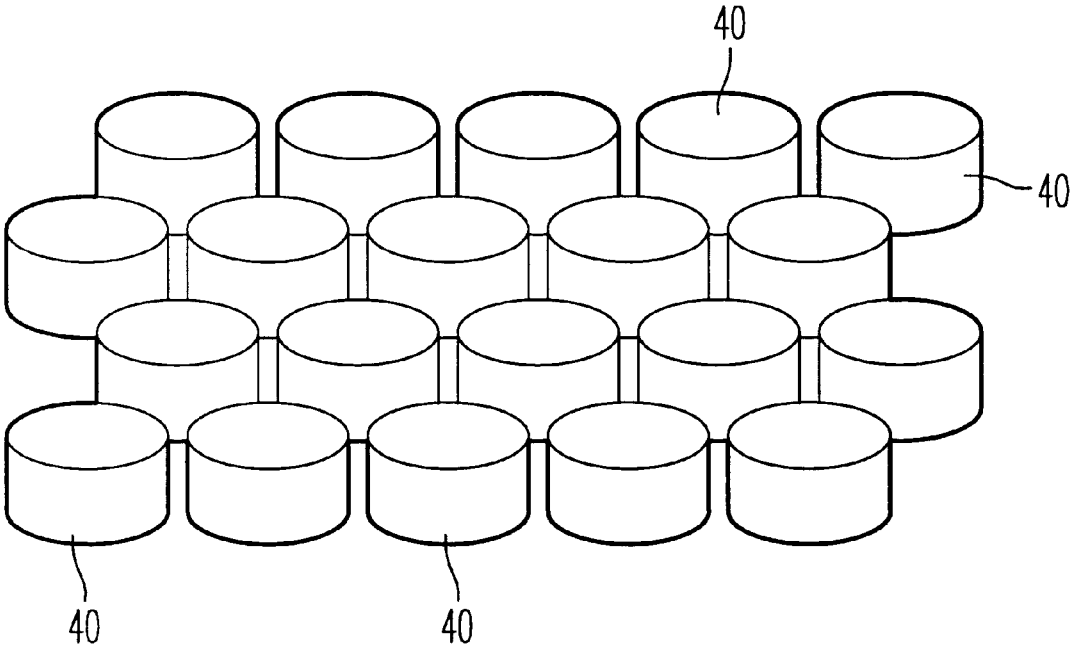
FIG. 9 is a schematic diagram of a two dimensional display using light emitting elements of the present invention.

It is possible to manufacture one-, two-, or a three-dimensional display by integrating the light emitting elements of the present invention into the display. FIG. 9 schematically shows a two-dimensional display using light emitting elements 40 of the present invention. The light emitting elements 40 may themselves constitute separate pixels, or groups of colored elements may form separate pixels.

The distance between the lower electrode 21 or 21*a* and the transparent electrode 24, is precisely defined by the thickness of the diamond film 27, and accurately determined when the light emitting element is manufactured. Therefore, the brightness of the display can be uniform. Moreover, the heat generated from the light emitting elements can be quickly diffused due to the high thermal conductivity of the diamond, and hence local overheating can be avoided. For this reason, uniform and stable light emission, long lifetime, and high power handling capacity are realized in the present invention.

EXAMPLES

Additional and complementary features of the present invention will become even more clear in light of the following non-limiting examples and alternate embodiments:

Example 1

Figure 10:
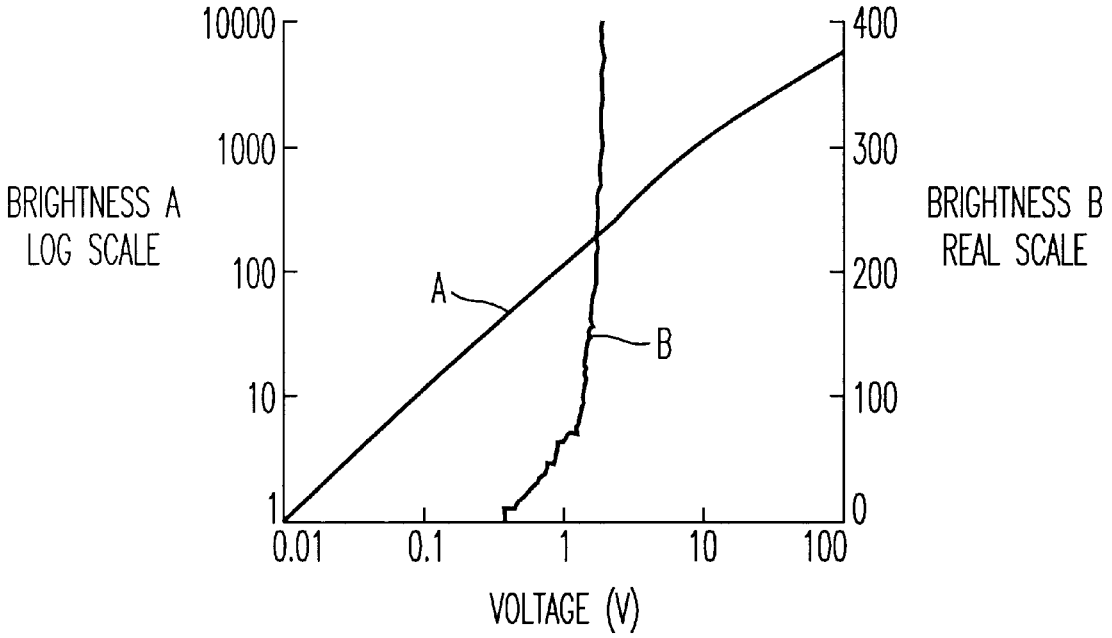
FIG. 10 shows the relationship between the brightness and the voltage of the light emitting elements according to the present invention.

In this example, a process for forming the element is described, followed by observed performance characteristics of the resulting structure. First, a Pt film of 5 $\mu$m in thickness was deposited on an alumina base (10 mm×10 mm) by sputtering. Then, an undoped diamond thin film of 3 $\mu$m thickness was deposited by microwave plasma CVD. Subsequently, a blue fluorescent film and ITO were successively deposited in a circle of 100 $\mu$m diameter on the undoped diamond thin film using a metal mask. The thickness of the fluorescent material as well as ITO was about 1 $\mu$m. The brightness was measured by changing the applied voltage between the Pt electrode as a lower electrode and the ITO as an upper electrode. FIG. 10 shows the relationship between the brightness and the applied voltage. It is clearly seen that the brightness markedly increased when electric field is greater than $10^4$ V/cm which corresponds with a voltage V>1 volt.

Example 2

In a similar experiment as in Example 1, a heavily boron-doped diamond layer, in which the boron concentration was around $10^{19}/cm^3$, was deposited to a 0.1 $\mu$m thickness on the surface of the Pt film prior to the deposition of the undoped diamond film. Then, an undoped diamond thin film was deposited thereon to a 3 $\mu$m thickness. The brightness in the blue color region was also measured in the same way as in Example 1. As a result, almost the same value of brightness as in Example 1 was obtained, but the current was only 80% of that of the structure of Example 1.

Example 3

As with Example 1, a manufacturing process is described for a particular light emitting element followed by a discussion of the performance observed with the resulting structure. Pt/Au alloy thin films, which had various atomic concentration ratios, were deposited on silicon nitride as a base material. Undoped diamond thin films of 3 $\mu$m thickness were subsequently grown on the substrates by microwave plasma CVD, and the Raman spectra of these diamond thin films were measured. In the Raman spectrum of diamond, there exists a characteristic peak from diamond at around 1333 $cm^{-1}$, and it is well known that the full-width at half maximum (FWHM) of the peak is smaller when the quality of diamond is better.

Figure 11:
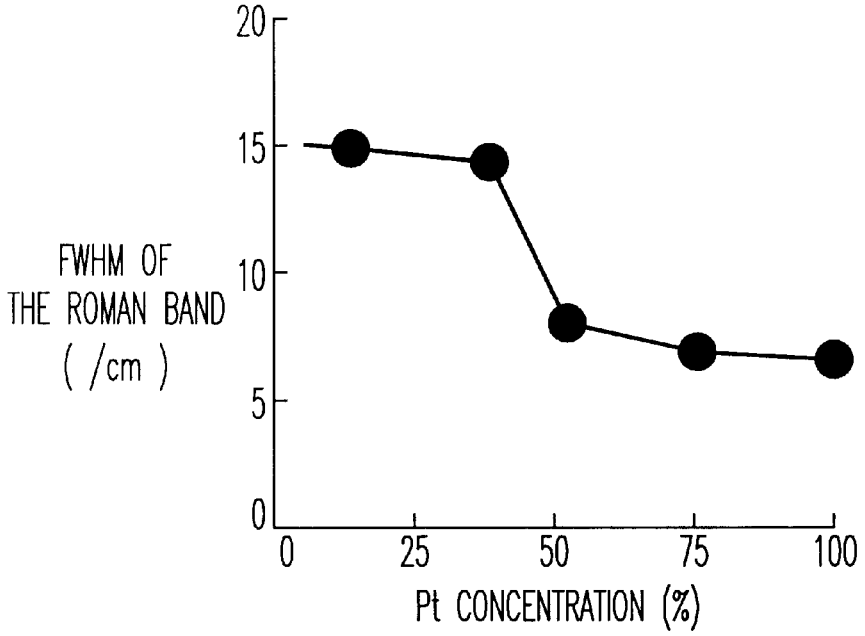
FIG. 11 shows the relationship between the full-width at half maximum (FWHM) of the Raman band of diamond at 1333 cm−1 and the Pt concentration in the lower electrode.
Figure 12:
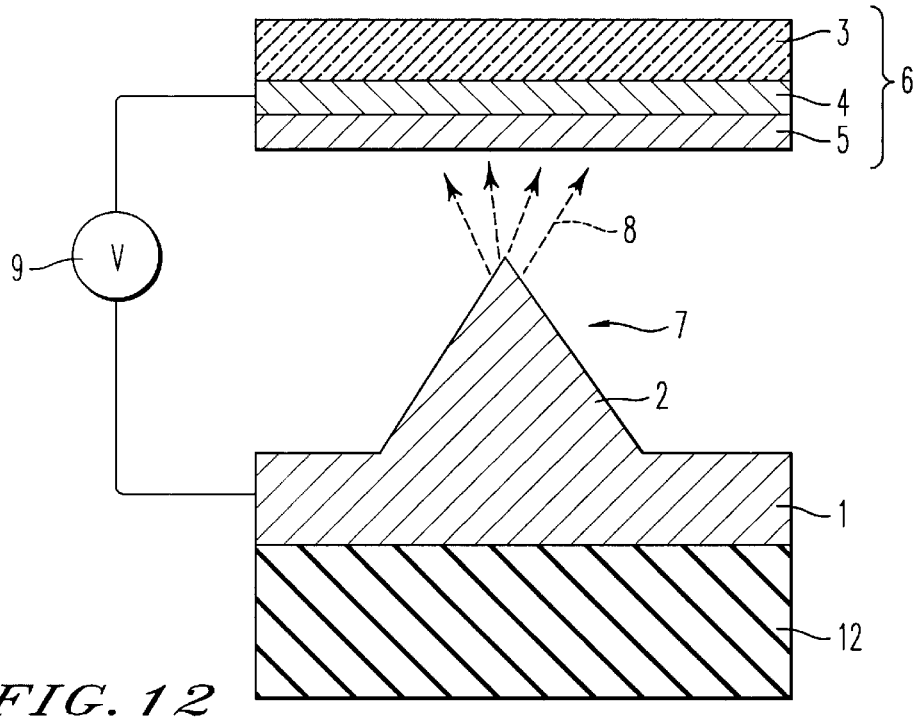
FIG. 12 PRIOR ART
FIGS. 12 and 13 are cross- sectional views of conventional light emitting using Si, respectively.
Figure 13:
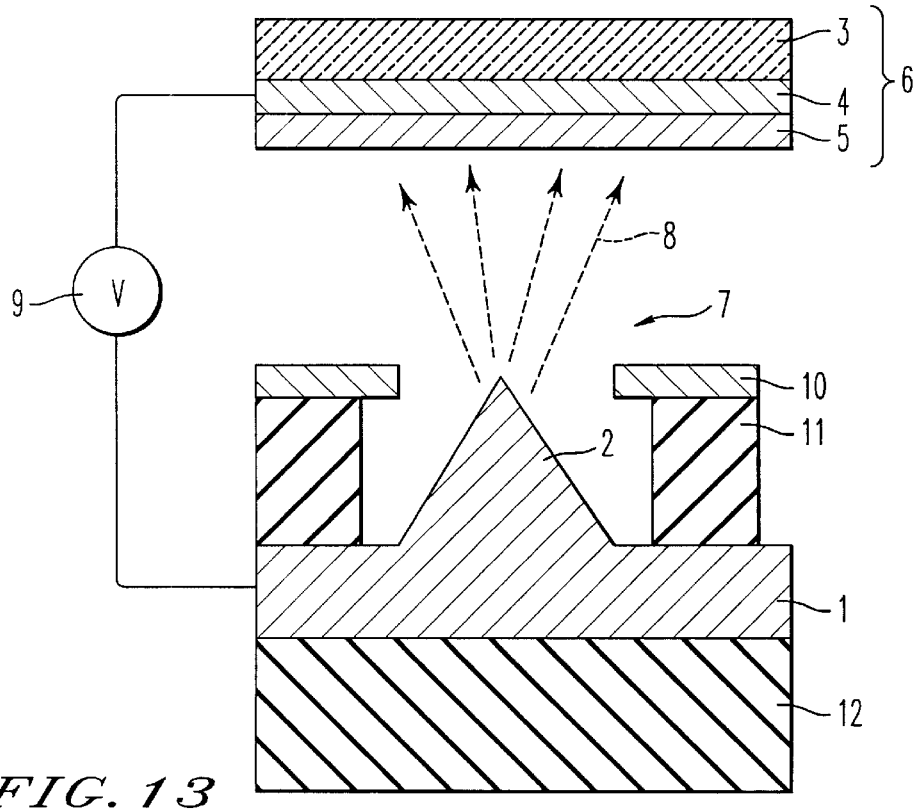
FIG. 13 PRIOR ART

FIG. 11 shows the relationship between the FWHM and the Pt concentration in the Pt alloy films. It is seen that a high quality diamond was obtained when the Pt atomic concentration is greater than 50 atomic %.

Example 4

As with Examples 1 and 3, a manufacturing process followed by observed characteristics of the resulting structure will be explained. A Pt circuit pattern of 2 $\mu$m in thickness was deposited on an alumina base (50 mm×50 mm) by sputtering. An undoped diamond thin film was grown to a 3 $\mu$m thickness on the substrate by microwave plasma CVD. Then, a circular mask of $SiO_2$ with a diameter of 3 $\mu$m was formed on the surface of the undoped diamond thin film, and the area except for the masked area was etched to a 1.5 $\mu$m depth by Electron Cycrotron Resonance (ECR) plasma etching using oxygen gas. Then, a gate electrode circuit pattern was formed with Al at the bottom of the etched diamond. After the deposition of $SiO_2$ film on the sample surface, the surface was planarized by Ar sputtering until the central diamond surface was exposed.

Subsequently, a transparent plate, on which a circuit pattern of the transparent electrode (ITO) of 0.5 $\mu$m in thickness and a fluorescent thin film had been deposited, was put on the surface of the diamond film so that the fluorescent thin film was put in contact with the diamond thin film. Thus, a flat panel display with diamond light emitting elements was made. A voltage of 25 V was applied between the Pt electrode as the lower electrode and the ITO as an upper electrode with the Pt electrode biased negatively, and the gate voltage was changed from −2 to 2 V. As a result, a color motion image was displayed.

Example 5

In Example 5, a heavily boron-doped diamond layer of 0.1 $\mu$m in thickness, in which the boron concentration was around $10^{19}/cm^3$, was formed on the Pt film prior to the deposition of the undoped diamond film. Then, an undoped diamond film was formed to a 3 $\mu$m thickness. After that, a flat panel display was formed in a similar way to that described in reference to Example 4. Then, a voltage of 25 V voltage was applied between the Pt electrode as a lower electrode and the ITO as an upper electrode with the Pt electrode biased positively, and applied voltages to the gate voltage were changed from −2 to 2 V. As a result, a color motion image was displayed.

Light emitting elements using diamond film have been discussed herein where features of the elements include a long lifetime and a high power handling capability. Flat panel displays using the diamond light emitting elements have been shown to exhibit a low electricity consumption and a high brightness. In the present light emitting elements, the carrier injection efficiency is greatly improved, when the surface of the lower electrode is rough. By doping boron in the diamond film and controlling the boron concentration properly, a light emission was obtained at a much lower voltage, Obviously, numerous additional modifications and variations of the present invention are possible in light of the above teachings. It is therefore to be understood that within the scope of the appended claims, the invention may be practiced otherwise than as specifically described herein.

I claim:

1. A light emitting element comprising:

a lower electrode;

a diamond film formed on a surface of said lower electrode and configured to transport carriers injected from said lower electrode;

a fluorescent film formed on a surface of said diamond film and configured to fluoresce due to excitation by the carriers injected from the lower electrode and through the diamond film; and an upper electrode formed on a surface of said fluorescent film.

2. The light emitting element of claim 1, wherein:

said lower electrode comprises at least one of Pt and Pt alloys with Pt greater than 50 atomic %, and a conducting material that includes diamond.

3. The light emitting element according to claim 1, wherein the surface of said lower electrode is rough.

4. The light emitting element according to claim 2, wherein the surface of said lower electrode is rough.

5. The light emitting element according to claim 1, wherein said carriers are holes.

6. The light emitting element of claim 1, wherein said diamond film is undoped.

7. The light emitting element of claim 1, wherein said diamond film is boron doped with a boron concentration being less than $1\times10^{18}/cm^3$.

8. The light emitting element of claim 7, wherein the boron concentration has a profile that is continuously modulated along a thickness direction of said diamond film.

9. The light emitting element of claim 5, further comprising a heavily boron-doped layer with a boron concentration being greater than $1\times10^{18}/cm^3$ and being formed in said diamond film within 1 mm from the surface of said lower electrode.

10. The light emitting element of claim 1, wherein said upper electrode includes a transparent conducting film.

11. The light emitting element of claim 1, wherein light emitted by the fluorescent film is visible light that can be observed without magnification if the electric field in said diamond film is greater than $10^4$ V/cm.

12. The light emitting element of claim 1, further comprising an insulating base material under said lower electrode.

13. A light emitting element comprising:

a lower electrode;

a diamond film formed on a surface of said lower electrode and configured to transport carriers injected from said lower electrode;

a fluorescent film formed on a surface of said diamond film and configured to fluoresce due to excitation by the carriers injected from the lower electrode and through the diamond film;

an upper electrode formed on a surface of said fluorescent film; and a gate electrode formed on a preselected area of a surface of said diamond film and configured to control a flow of said carriers.

14. The light emitting element of claim 13, further comprising an insulating intermediate layer between said gate electrode and said diamond film.

15. The light emitting element according to claim 13, wherein:

said lower electrode comprises at least one of Pt and Pt alloys with Pt greater than 50 atomic %, and a conducting material that includes diamond.

16. The light emitting element according to claim 13, wherein the surface of said lower electrode is rough.

17. The light emitting element according to claim 13, wherein said carriers are holes.

18. The light emitting element according to claim 13, wherein said diamond film is undoped.

19. The light emitting element according to claim 13, wherein said diamond film is boron doped with a boron concentration being less than $1\times10^{18}/cm^3$.

20. The light emitting element according to claim 19, wherein a profile of said boron concentration is continuously modulated along a thickness direction of said diamond film.

21. The light emitting element according to claim 17, further comprising a heavily boron-doped layer with a boron concentration being greater than $1\times10^{18}/cm^3$ and being formed in said diamond film within 1 mm from the surface of said lower electrode.

22. The light emitting element according to claim 13, wherein said upper electrode includes a transparent conducting film.

23. The light emitting element according to claim 13, wherein light emitted by the fluorescent film is visible light that can be observed without magnification if the electric field in said diamond film is greater than $10^4$ V/cm.

24. The light emitting element according to claim 13, further comprising an insulating base material under said lower electrode.

25. A flat panel display comprising:

a light emitting element comprising, a lower electrode, diamond film formed on a surface of said lower electrode and configured to transport carriers injected from said lower electrode, a fluorescent film formed on a surface of said diamond film and configured to fluoresce due to excitation by the carriers injected from the lower electrode and through the diamond film, and an upper electrode formed on a surface of said fluorescent film.

26. A flat panel display comprising:

a light emitting element having, a lower electrode, a diamond film formed on a surface of said lower electrode and configured to transport carriers injected from said lower electrode, a fluorescent film formed on a surface of said diamond film and configured to fluoresce due to excitation by the carriers injected from the lower electrode and through the diamond film, an upper electrode formed on a surface of said fluorescent film, and a gate electrode which is formed on a preselected area of a surface of said diamond film and configured to control a flow of said carriers.

* * * * *